United States Patent [19]

Axelrod

[11] 4,420,282

[45] Dec. 13, 1983

[54] METHOD FOR BINDING BOOKS

[75] Inventor: Herbert R. Axelrod, Deal, N.J.

[73] Assignee: Permatek, Inc., Las Vegas, Nev.

[21] Appl. No.: 145,018

[22] Filed: Apr. 30, 1980

[51] Int. Cl.[3] ..... B42C 9/00; B42C 19/04

[52] U.S. Cl. ..... 412/4; 412/19

[58] Field of Search ..... 11/1 AD, 1 R, 2, 4; 281/28; 412/4, 8, 19, 17, 21, 24, 27, 37, 30

[56] References Cited

U.S. PATENT DOCUMENTS

| | | | |
|---|---|---|---|
| 1,665,049 | 4/1928 | Baker | 11/2 UX |
| 3,093,396 | 6/1963 | Segreto | 11/1 AD X |
| 3,188,114 | 6/1965 | O'Brien | 11/1 R X |
| 4,019,758 | 4/1977 | Heller, Jr. | 11/1 AD |
| 4,091,487 | 5/1978 | Axelrod | 11/1 AD |
| 4,106,148 | 8/1978 | Axelrod | 11/1 AD |
| 4,187,572 | 2/1980 | Savich | 11/1 R |

*Primary Examiner*—Paul A. Bell
*Assistant Examiner*—John S. Brown
*Attorney, Agent, or Firm*—Daniel M. Rosen

[57] ABSTRACT

A method for binding a book wherein the backbone of printed and folded signatures receives a heat activated glue. A short reinforcing cover whose inner surface is also covered with a heat activated glue is applied to the backbone. The outer portions of the short cover are then bonded to the outer pages of the signatures, under sufficient heat and pressure to form a strong bond. A hard cover of suitable size and shape is then glued to the outside of the short cover and the signatures.

20 Claims, 7 Drawing Figures

METHOD OF BOOK BINDING

METHOD FOR BINDING BOOKS

BACKGROUND OF THE INVENTION

The art of book binding is centuries old, and vital to the flow and storage of information. It is constantly being improved, but is still limited by the number of steps necessary to asssemble, collate and secure signatures and turn the assembled signatures into a finished book, as well as by the comparative weakness of the binding of the finished book. For example, in case binding for hard-cover books, considerable hand labor, skill and expensive equipment are required to sew and glue collated signatures together. Conventional perfect adhesive binding for paperback books, while less expensive than case binding, has neither the same high quality appearance, nor the strength, as that of hard cover books.

Applicant's U.S. Pat. No. 4,091,487, issued May 30, 1978, for a "Method For Binding Books" discloses an important improvement over conventional book binding, wherein the signatures are first collated, and then the spines or backbones of the signatures are cut off to provide a single backbone exposing every sheet in every signature, and whose edges can be glued together and to at least one paper cover that will ultimately be glued to the interior surfaces of a conventional hard cover, after the other three edges of the assembled and collated signatures are trimmed.

Applicant's U.S. Pat. No. 4,106,148, issued Aug. 15, 1978, for a "Method of Binding Papers", discloses an additional improvement over conventional book binding, wherein notches or apertures are cut into the spines at intervals to permit the flow of adhesive glue well into the backbone of all of the pages in every signature. This method avoids the waste of paper and the extra step of grinding the backbone while still eliminating the even-more-costly step of sewing the signatures.

While the methods disclosed in the two above-identified patents are a considerable improvement over the more time-consuming and costly book binding systems of the prior art, such methods share the mechanical weakness of the prior ar book binding methods in that the signatures are fastened, by thread or glue, to a single central edge of a cover than can be relatively easily broken away from the binding. Thus, if the signatures are grasped in one hand, and the paper cover or the hard cover grasped in the other hand, the single, narrow bonding can be pulled apart relatively easily.

SUMMARY OF THE INVENTION

It is a major object of the present invention to provide a method for fastening collated signatures to a conventional hard cover that is simpler and involves fewer steps than existing methods, so as to reduce the time, labor and cost of conventional book binding.

It is a further object of the present invention to provide a method for producing a book that has a substantially stronger backing that resists being broken apart far more successfully than books produced by any of the typical book binding methods of the comparable prior art.

It is yet a further object of the present invention to provide a method for book binding utilizing fewer elements, less materials, and a better finished book at low cost utilizing basic equipment commonly available at most book binderies.

These and other objects of the present invention are achieved by a method for binding books wherein the signatures are assembled and collated in the usual manner, and the spines or backbones are aligned to provide a common, new backbone to which is applied a penetrating heat activated glue. Instead of the usual gauze or crash lining, then being attached to the new spine while the glue is still wet, a novel, short cover or reinforcing sheet is glued along the backbone of the newly-glued edges of the signatures with hot melt adhesive.

An important facet of the method of the present invention is that the novel short cover has its inner surface, adjacent to the signatures, coated or impregnated with a heat-and-pressure activatable, heat activated glue. At this point the short cover or reinforcing sheet may look like a standard cover, and is attached to the backbone or back edges of the signatures in the normal way, but the next step in this method is to fold the side portions of this reinforcing sheet tightly against the outer surface of the first page of the first signature and the outer surface of the last page of the last signature, and to apply enough heat and pressure to activate the heat activated glue for a permanent bond.

As a final step in the method of the present invention, the interior surfaces of a conventional hard cover are glued to the outer surfaces of the side portions of the reinforcing sheets and of the exposed portions of the first page of the first signature and the last page of the last signature. The assembled hard cover book can then be indented in the normal manner to form the hinge and assure a good bond between the hard covers and the reinforced collated signatures.

Other objects and advantages of the present invention will become apparent from the following detailed description of a preferred embodiment thereof.

DESCRIPTION OF A PREFERRED EMBODIMENT

Figure 1:
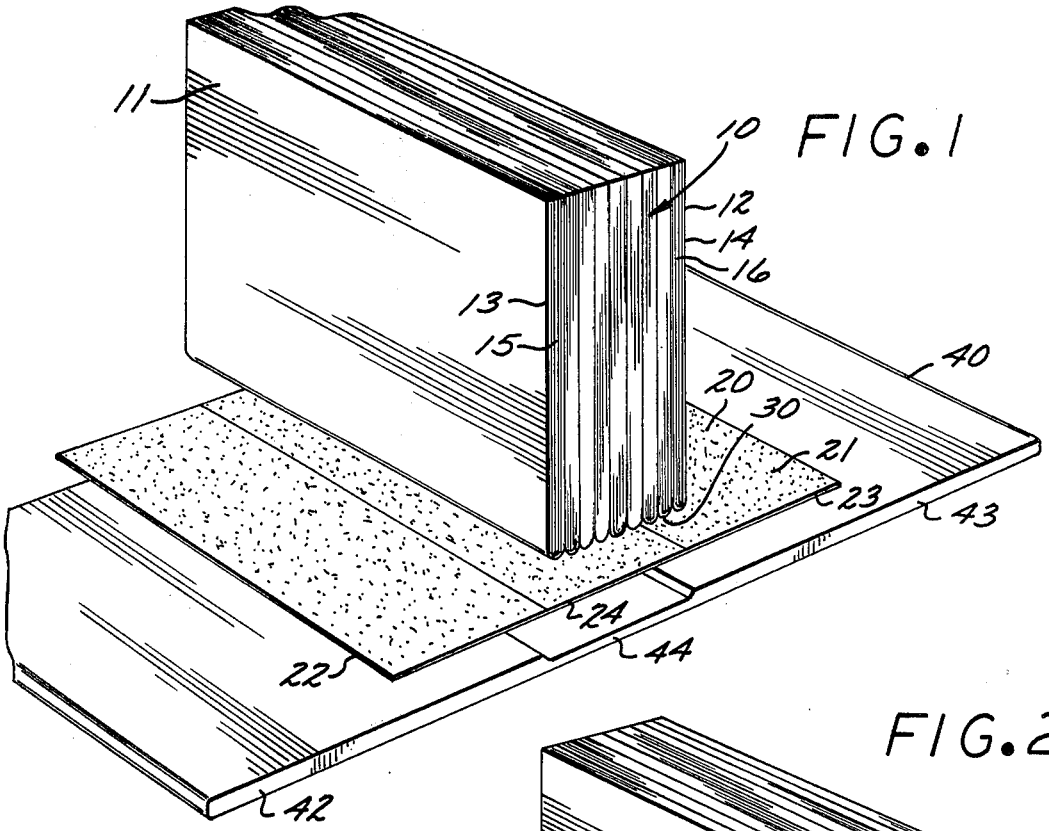
FIG. 1 is an isometric vertically exploded view of the elements employed in carrying out one embodiment of the present invention.

Referring to the drawings and more particularly to FIG. 1, there is shown a vertically exploded isometric view of the major elements of a book to be assembled according to a preferred method embodying the present invention. Reference numeral 10 designates a stack of printed signatures, with their spines or backbones (not shown) cut off to provide a single spine or backbone 30 in which every sheet of every signature has a bottom exposed edge. Signatures 10 are collated so that pagination is in seriatim. A first page 11 of a first sheet 13 of a first signature 15 can be seen, as well as a last page 12 of a last sheet 14, of a last signature 16. A horizontally extending reinforcing sheet or short cover 20 appears below the assembled signatures 10, to which such short cover will be glued. The short cover is pre-coated with a heat sensitive coating, such as a conventional heat activated glue, on its upper surface 21. The short cover 20 includes side portions 22 and 23, and a mid portion 24. Below the reinforcing short cover 20 is seen a horizontally extending conventional hard cover 40, that includes side portions 42 and 43, and a mid portion 44.

Figure 2:
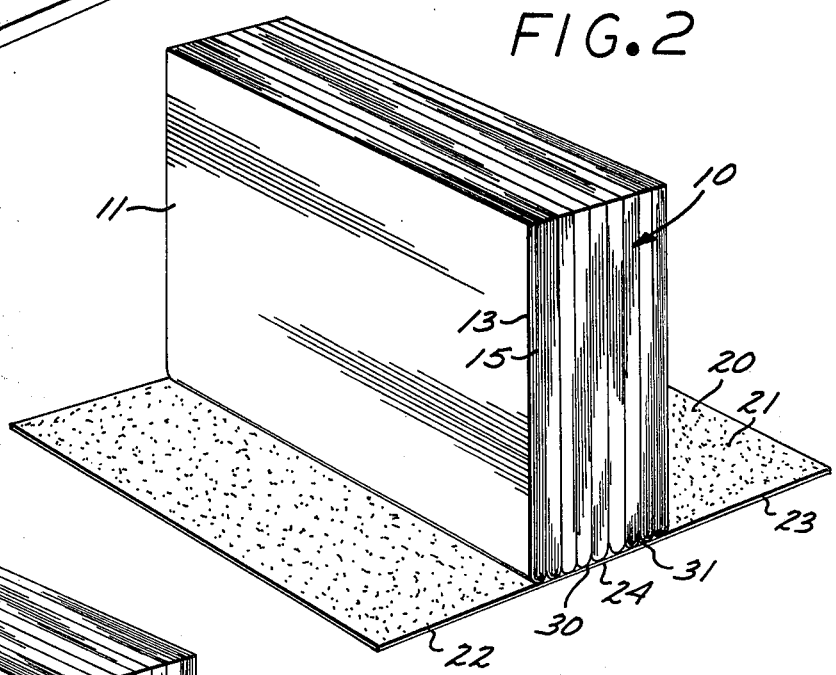
FIGS. 2 and 3 are isometric views showing later steps of the method of the present invention.

FIG. 2 represents an isometric view of the assembled signatures 10 and short cover 20 after they have been joined together. All of the pages of all of the signatures are shown glued together and to the mid portion 24 of the short cover 20 by a heat activated glue 31. The side portions 22 and 23 of the short cover may still extend outwardly from the mid portion 24. This operation, known as "perfect" or "adhesive binding" may be performed on conventional machines commonly in use in binderies at speeds usually from 1,000 to 10,000 books per hour.

Figure 3:
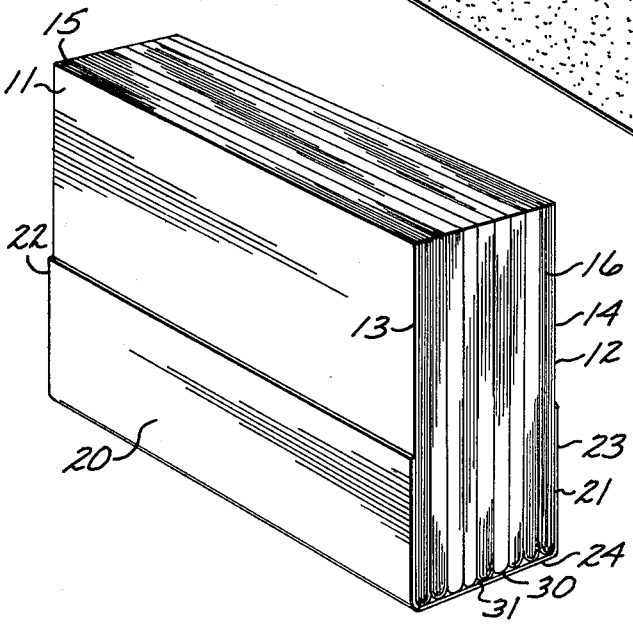

FIG. 3 represents an isometric view of the elements of FIG. 2, with the side portion 22 of the short cover 20 drawn up and heat-sealed to the first page 11 of the first sheet 13 of the first signature 15, and the side portion 23 drawn up and heat sealed to the last page 12 of the last sheet 14 of the last signature 16.

Figure 4:
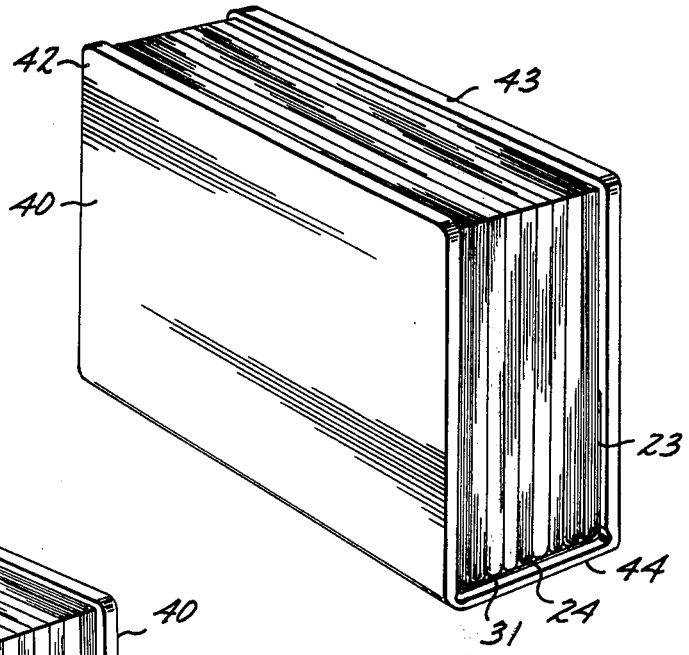
FIGS. 4 and 5 are isometric views of final steps of said method.

FIG. 4 represents an isometric view of the elements of FIG. 3 with the inside of the side portion 42 of hard cover 40 glued to the outside of the side portion 22 of the short cover 20 and to the first page 11 (not visible), and the inside of the cover's side portion 43 glued to the outside of the side portion 23 of the short cover and to the last page 12 of the last sheet of the last signature (not visible).

Figure 5:
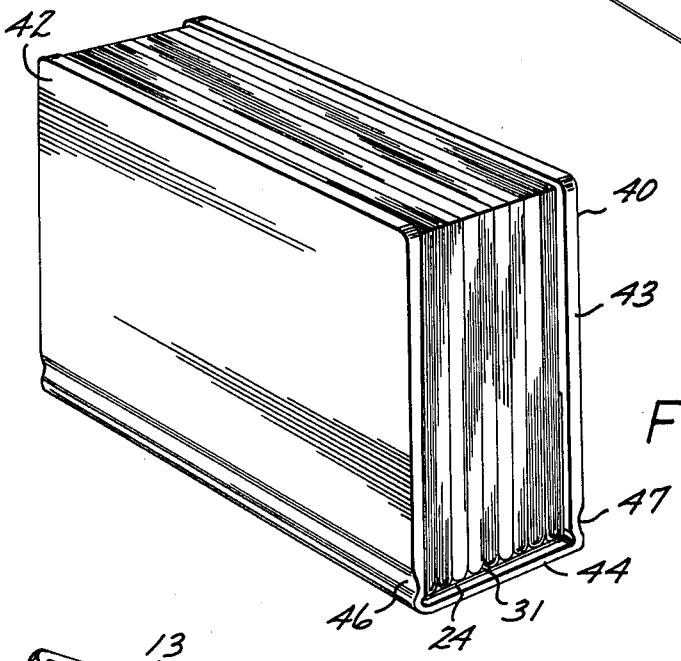

FIG. 5 represents an isometric view of the book elements shown in FIG. 4 with like indentations 46 and 47 impressed close to the spine 30 above the glue 31.

Figure 6:
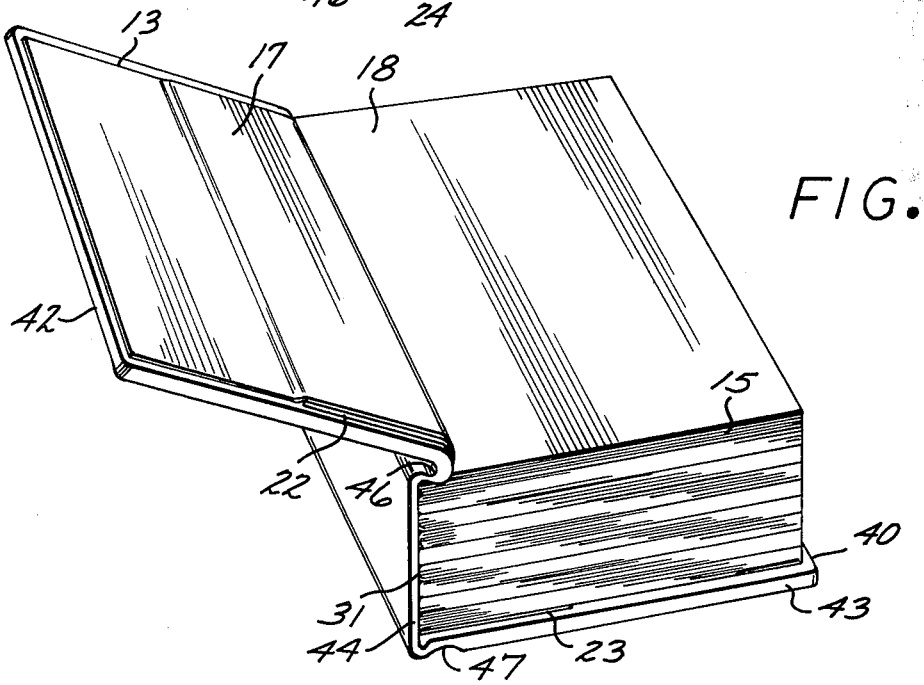
FIG. 6 is an isometric view of a finished book produced in accordance with the present invention, the front cover of such book being open.
Figure 7:
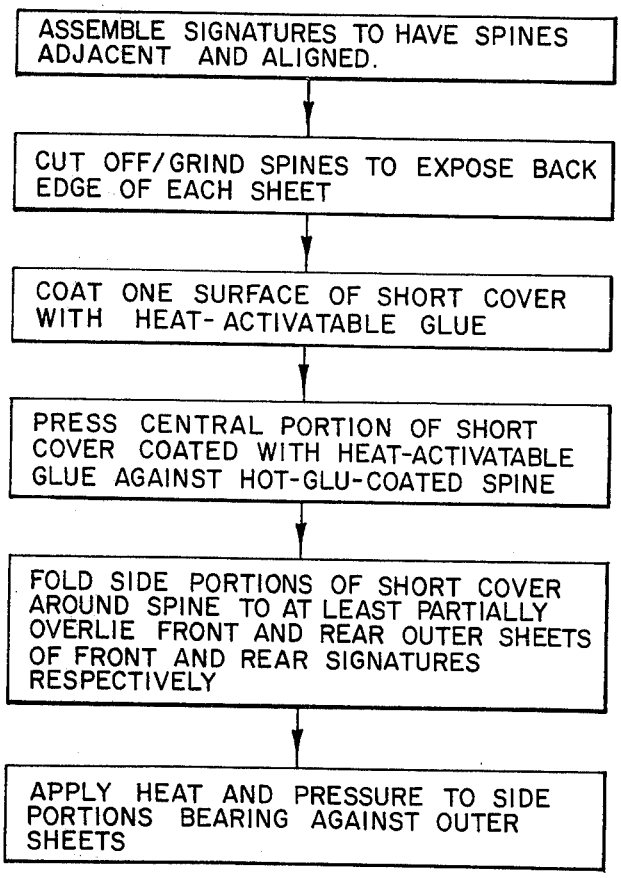
FIG. 7 is a flow diagram of the method of the present invention.

FIG. 6 represents an isometric view of the finished book of FIG. 5 with its front cover 42 open to illustrate the flexing at indentation 46 and the simplicity of the binding. This view clearly discloses the second page 17 of the first sheet 13 and the third page 18 of the second sheet of the first signature 15. The latter is now the first page of the bound book. The side portion 22 of short cover 20 or reinforcing sheet may be seen bonded to the first page 11 and glued to the inside of the side portion 42 of the hard cover.

In carrying out the method of the present invention, the printed folded signatures are assembled and collated in proper pagination sequence for the finished book. The precise alignment or registration of each page will, of course, have been made to the best of the abilities of the machines and operators in the prior stages of printing and folding. In the preferred embodiment of the invention, the assembled signatures are first passed through a grinder that cuts off the spines or backbones of all of the assembled signatures to produce exposed flat edges of all the pages, and provide the new flat backbone 30.

This new flat backbone 30 is passed over a gluing device that spreads a heat activated glue 31 over the edges of the pages to penetrate and bind the edges of the pages of the backbone together. The backbone, with the glue still wet, is immediately placed on the mid portion 24 of the short cover 20, which is pre-glued as described above, to bond them together. This arrangement would also be applicable to a stack of loose, collated and aligned pages, or even a writing pad. This application of heat activated glue to the backbone of the collated and aligned signatures 10 would also be applicable to the type of signatures described in my above-mentioned U.S. Pat. No. 4,106,148 whereby the heat activated glue will penetrate through the linear array of notches or apertures, to contact all of the papers to be bound. However, the method of the present invention does not require notching of the signatures and thereby eliminates the need for a notching machine.

Later, preferably after the glue has set, the assembled signatures 10 and short cover 20 with its still-unattached side portions 22 and 23 are passed through a machine that folds the side portion 22 of the reinforcing cover tightly against the first page 11 of the first signature, and the side portion 23 tightly against the last page 12 of the last signature, with heat and pressure being applied for a sufficient time to activate the heat activated glue and bond or seal the elements together. A conventional heat sealer usually operates at 250°–350° F. at 30–40 p.s.i. pressure, with a dwell of 1–2 seconds. A separate heat tunnel may be used prior to pressure sealing.

After the backbone 30 of the assembled signatures 10 are glued to the short cover 20 with heat activated glue, the other three edges of the collated signatures may be trimmed. The trimming of the other three edges of the collated signatures can be done either before or after the short reinforcing cover 20 is bonded to the first and last pages by activating the heat activated glue under suitable temperature and pressure. These elements are next put into a machine for attaching hard cover backs in the normal manner. Glue is applied to the outer surfaces of the side portions 22 and 23 of the reinforcing sheet, as well as to the exposed outer portions of the first and last pages of the assembled signatures, and the corresponding inside surfaces of the side portions 42 and 43 of hard covers are aligned with and applied to such elements. To complete the manufacture of the book, the indentations 46 and 47 are impressed in the outer portion of hard cover 40 adjacent backbone 30.

The reinforcing sheet or short cover 20 may be of paper, similar to that of the rest of the signatures, but, in practice, the short cover may be reinforced kraft paper, or a scrim, crash, or gauze-reinforced material depending on the strength desired. The essential reinforcing sheet or short cover 20 should, ideally but not necessarily, be of the height of the book, but need be only a part of the width of the book.

While a plurality of signatures would be normal for a standard book, it is obvious that a single signature, or even a stack of pre-cut sheets, could be bound in this manner.

It is to be understood that various modifications and changes may be made with respect to the foregoing detailed description without departing from the scope of the present invention.

I claim:

1. A method for binding books comprising the steps:

assembling a plurality of pages into a stack having front and rear outer pages with one edge of the stack forming a spine and each page having height and width dimensions, coating said spine with a flowable heat-activated glue, providing a reinforcing short cover having inside and outside surfaces, the short cover defining a central portion to overlie said spine and side portions to at least partially overlie said outer pages, coating the inside surface of said central and side portions of said short cover with a heat-activatable glue, pressing said glue-coated spine against said heat-activatable glue-coated central portion of said short cover and heating and activating the glue on said central portion for adhering said central portion to said spine, folding said side portions of the short cover to at least partially overlie said outer pages, pressing each side portion of the short cover against an adjacent outer page and applying heat thereto, thereby activating said glue on said side portions and adhering them to said outer pages respectively.

2. The method of claim 1 wherein said step of providing a reinforcing short cover comprises providing a short cover of reinforced kraft paper.

3. The method of claim 1 wherein said step of providing a reinforcing short cover comprises providing a short cover of a fabric reinforced material.

4. A method for binding books comprising the steps assemblying a plurality of signatures into a stack for binding, wherein the first page of the first signature and the last page of the last signature comprise the outer pages of the stack with one edge of the stack forming a spine and, each signature page having height and width dimensions, coating said spine with a flowable heat-activated glue, providing a reinforcing short cover having inside and outside surfaces, the short cover defining a central portion to overlie said spine and side portion to overlie said outer pages, coating the inside surface of said central and side portions of said short cover with a heat-activatable glue, pressing said glue-coated spine against said heat-activatable glue coated central portion of said short cover and heating and activating the glue on said central portion for adhering said central portion to said spine, folding said side portions of the short cover to at least partially overlie said outer pages, pressing each side portion of the short cover against an adjacent outer page and applying heat thereto, thereby activating said glue on said side portions and adhering them to said outer pages respectively.

5. A method according to claim 1 or 4 comprising the further step of dimensioning each of said side portions of said short cover to have width less than the width of said outer pages so that each side portion only partially overlies an adjacent outer page when folded thereagainst, thereby leaving exposed areas of said outer page.

6. A method according to claim 1 or 2 comprising the further step of dimensioning each of said side portions of said short cover to have width less than the width of said outer pages so that each side portion only partially overlies an adjacent outer page when folded thereagainst, thereby leaving exposed areas of said outer page, said method comprising the further steps of providing a hard outer cover having inner and outer surfaces and having sufficient height and width to overlie and cover said spine and said outer pages, and gluing the inner surfaces of said hard cover to the outer surfaces of said inner cover and to said exposed areas of said outer pages.

7. A method according to claim 1 or 4 comprising the further step of dimensioning each of said sidde portions of said short cover to have width equal to the width of said outer pages.

8. A method according to claim 1 or 4 comprising the further step of dimensioning each of said side portions of said short cover to havve height and width the same as height and width of said outer pages, whereby said short cover serves as an outer cover for a paperback book.

9. A method according to claim 4 wherein each signature comprises a plurality of sheets folded to form two pages, the method comprising the further step of cutting off the spines of the assembled signatures, thereby exposing along said spine an edge of every page to receive and absorb said heat-activatable glue.

10. A method according to claim 1 or 4 comprising the further step of dimensioning each of said side portions of said short cover to have width less than the width of said outer pages so that each side portion only partially overlies an adjacent outer page when folded thereagainst, thereby leaving exposed areas of said outer page, said method comprising the further steps of providing a hard outer cover having inner and outer surfaces and having sufficient height and width to overlie and cover said spine and said outer pages, and gluing the inner surfaces of said hard cover to the outer surfaces of said inner cover and to said exposed areas of said outer pages by applying glue to the outer surfaces of said side portions and to said exposed areas of said outer pages and pressing said inner surfaces of said hard cover against these glued surfaces.

11. A method according to claim 1 or 4 comprising the further steps of heating said flowable glue before coating said glue onto said spine, and subsequently heating said heat-activatable glue on said central portion of said short cover by contacting said heated glue on said spine with said central portion.

12. The method of claim 4 wherein said step of providing a reinforcing short cover comprises providing a short cover of paper of the type of the paper of said signature.

13. In an adhesive-bound cased-in book including a plurality of signatures formed into a stack with the first sheet of the first signature and the last sheet of the last signature being the outer sheets of the stack, the outer sheets having outer surfaces facing outwardly of the stack and one edge of the stack being the spine thereof, a layer of heat activated glue along said spine binding said signatures together, and an outer hard cover having a central part overlying said spine and side parts having inner surfaces overlying and facing said outer surfaces of said outer sheets, the improvement in combination therewith comprising:

a reinforcing short cover having a central portion and opposite side portions and inside and outside surfaces of said portions, said short cover situated with the inside surface of its central portion overlying said spine and glued thereto and the inside surfaces of its side portions folded around said spine and partially overlying said outer sheets respectively and glued to the outer surfaces of said outer sheets, each of said outer sheet's outer surfaces defining an exposed area not covered by the short cover's side portion glued thereto, said exposed area of each outer sheet plus the outer surface of the short cover's side portion being glued to the adjacent inner surface of a side part of said outer cover.

14. The book of claim 13 wherein said short cover is of a paper of the type of the paper of said signatures.

15. The book of claim 13 wherein said short cover is of reinforced kraft paper.

16. The book of claim 13 wherein said short cover is of a fabric reinforced material.

17. In an adhesive-bound case-in book including a plurality of sheets form into a stack with one edge of the stack being the spine thereof and the first and last sheets being the outer sheets thereof, each having an outer surface facing outward of the stack, a layer of heat activated glue along said spine binding said sheets together, and an outer cover having a central part overlying said spine and side parts having inner surfaces overlying and facing said outer surfaces of said outer sheets the improvement in combination therewith comprising:

a reinforcing short cover having a central portion and opposite side portions and inside and outside surfaces of said portions, said short cover situated with the inside surface of its central portion overlying said spine and glued thereto and the inside surfaces of its side portions folded around said spine and partially overlying said outer sheets respectively and glued to the outer surfaces of said outer sheets, each of said outer sheet's outer surfaces defining an exposed area not covered by the short cover's side portion glued thereto, said exposed area of each outer sheet plus the outer surface of the short cover's side portion being glued to the adjacent inner surface of a side part of said outer cover.

18. In an adhesive-bound cased-in book including a plurality of signatures formed into a stack with the first sheet of the first signature and the last sheet of the last signature being the outer sheets of the stack the outer sheets having outer surfaces facing outwardly of the stack and one edge of the stack being the spine thereof, a layer of heat activated glue along said spine binding said signatures together, and an outer hard cover having a central part overlying said spine and side parts having inner surfaces overlying and facing said outer surfaces of said outer sheets, the improvement in combination therewith comprising:

a reinforcing short cover having a central portion and opposite side portions and inside and outside surfaces of said portions, said short cover situated with the inside surface of its central portion overlying said spine and glued thereto and the inside surfaces of its side portions folded around said spine and substantially completely overlying said outer sheets respectively and glued to the outer surfaces of said outer sheets, and said outer surfaces of the short cover's side portions being glued to the adjacent inner surfaces of side parts respectively of said outer cover.

19. A book according to claims 13, 17 or 18 wherein said inside surface of said short cover's central and side portions comprises a layer coated thereon of heat-activatable glue which having been heat-activated adheres said inside surfaces of said short cover to said spine and outer sheets.

20. A method of adhesive bookbinding including use of a reinforcing short cover having a central portion and opposite side portions and defining inside and outside surfaces of said portions, the inside surface of said central and side porrtions of said short cover being coated with dried, heat-activatable glue, the method comprising the steps of assembling a plurality of pages with one edge of the stack forming a spine and each page having height and width dimensions, coating said spine with a flowable, heated glue, positioning said short cover to have its central portion against and overlying said spine coated with heated glue, pressing said glue-coated spine against said heat-activatable glue-coated central portion of said short cover and heating and activating the glue on said central portion for adhering said central portion to said spine, folding said side portions of the short cover to at least partially overlie said outer pages, pressing each side portion of the short cover against an adjacent outer page and applying heat thereto, thereby activating said glue on said side portions and adhering them to said outer pages respectively.

* * * * *